United States Patent [19]

Gaitos et al.

[11] 4,390,297

[45] Jun. 28, 1983

[54] METHOD AND APPARATUS FOR CORRECTION OF NON-IMPACT PRINTING

[75] Inventors: Janise N. Gaitos, San Jose; Meredith D. Shattuck, Hollister; Clayton V. Wilbur, San Jose, all of Calif.

[73] Assignee: International Business Machines Corporation, Armonk, N.Y.

[21] Appl. No.: 219,197

[22] Filed: Dec. 22, 1980

[51] Int. Cl.[3] ..... B41J 29/16

[52] U.S. Cl. ..... 400/697.1; 400/120; 400/466

[58] Field of Search ..... 400/120, 466, 696, 697, 400/697.1, 208

[56] References Cited

U.S. PATENT DOCUMENTS

| | | | |
|---|---|---|---|
| 3,773,160 | 11/1973 | Rava et al. | 400/697 X |
| 3,855,448 | 12/1974 | Hanagata et al. | 400/120 X |
| 3,862,679 | 1/1975 | Ozimek et al. | 400/697 |
| 3,866,736 | 2/1975 | Ozimek et al. | 400/697 |
| 4,108,557 | 8/1978 | Skrzipek et al. | 400/697.1 |
| 4,120,594 | 10/1978 | Howard | 400/697 |
| 4,203,677 | 5/1980 | Hatsell | 400/697.1 X |
| 4,247,210 | 1/1981 | Kacmarcik et al. | 400/208 X |
| 4,268,181 | 5/1981 | Decker | 400/697.1 X |
| 4,302,118 | 11/1981 | Schaefer | 400/697.1 X |

FOREIGN PATENT DOCUMENTS

| | | | |
|---|---|---|---|
| 528589 | 11/1940 | United Kingdom | 400/697 |
| 2030076 | 4/1980 | United Kingdom | 400/208 |

*Primary Examiner*—Ernest T. Wright, Jr.
*Attorney, Agent, or Firm*—Otto Schmid, Jr.

[57] ABSTRACT

A method and apparatus for correction of non-impact printed material which is formed by depositing a thermoplastic marking material on the print sheet. The method and apparatus uses a correction tape or ribbon comprising a substrate which carries a pressure transferable pigmented material on one face. The correction ribbon is positioned between the erroneously printed character and a correction device which is actuated to produce sufficient pressure to move the correction ribbon into intimate contact with the erroneously printed character, and the pigmented material is transferred selectively only to the character area to cover the erroneously printed character, so that the correct character can then be printed. In an alternate embodiment, the correction device is actuated concurrently with a backspace operation.

5 Claims, 11 Drawing Figures

METHOD AND APPARATUS FOR CORRECTION OF NON-IMPACT PRINTING

DESCRIPTION

TECHNICAL FIELD

This invention relates to a method and apparatus for correcting printed characters and more particularly to a method and apparatus for correcting characters printed by non-impact printing techniques.

BACKGROUND ART

Various techniques have been known in the prior art for erasing erroneously printed characters. These techniques include both lift off systems and cover up systems which have been commercialized for impact printers such as typewriters. These systems require an accurately registered overstrike of the character printed in error with a correction ribbon rather than the printing ribbon in place. However, in non-impact printing systems, no character shaped element is present so that conventional impact printing methods and apparatus cannot be used. Some prior art techniques were designed for correction which do not require accurate alignment of a character shaped element and thus were operable in principle to erase printing produced by non-impact printing techniques. One such system which utilizes impact correction techniques is shown in U.S. Pat. Nos. 3,862,679 and 3,866,736. This apparatus provides for a special key carrying a universal obliterating type font which is controlled in conjunction with a cover-up correction ribbon to produce a cover-up area large enough to cover any character within the type font being used. This correcting technique has not been well accepted for impact printing correction since the large cover-up area may be very noticeable.

In addition, this method would not be expected to produce good operation in a non-impact printing system due to the difference in printing characteristic between the plain paper and the large area of cover-up material. Other correction systems have utilized such techniques as lasers, heat sources, liquid cover-up or aerosols to produce a correction operation, and consequently required more complex methods and apparatus to perform a correction operation.

DISCLOSURE OF INVENTION

In accordance with the present invention, we provide a method and apparatus for correcting non-impact printing which was produced by depositing thermoplastic marking material on a print sheet by utilizing a corrective ribbon which carries a pressure transferable opaque adherent pigment on one face thereof. The corrective ribbon is interposed between the print sheet and a printing head and pressure is produced to move the corrective ribbon into intimate contact with the erroneously printed character and the pigment is transferred selectively from the corrective ribbon only to the character so that the erroneously printed character is covered and the correct character can then be printed.

Alternate embodiments are disclosed for producing the selective pressure to move the corrective tape into intimate contact with the erroneously printed character. In one embodiment, an impact hammer is energized after a back space operation is completed. In a second embodiment an erase blade member is held in a pressure position as the back space operation is performed. A third embodiment is disclosed in which a roller member is held in a pressure position as the back space operation is performed.

BRIEF DESCRIPTION OF DRAWING

Our invention will be described in connection with the accompanying drawing, in which:

FIG. 7 is a timing diagram showing the relative times for actuation of the various components of the printing apparatus during a correction cycle; and FIG. 8 is a timing diagram showing the relative times for actuation of the various components of the printing apparatus during an alternate embodiment of the correction cycle.

BEST MODE FOR CARRYING OUT THE INVENTION

Figure 1:
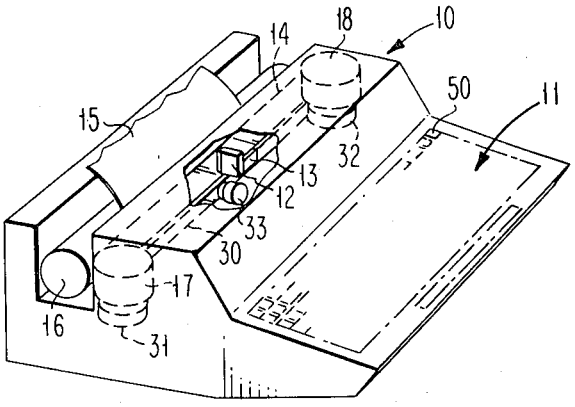
FIG. 1 is a perspective view of a printing apparatus embodying the invention.

The correction apparatus embodying the invention is shown illustratively associated with a typewriter-like printing apparatus 10 comprising a conventional keyboard 11. The keyboard 11 generates coded data to control a print head 12. Print head 12 is mounted in a carriage 13 that is movable transversely of apparatus 10 but parallel to the feed path of a ribbon 14. Print head 12 presses ribbon 14 against a record medium 15 that is backed up by a platen 16. As in conventional typewriters, ribbon 14 is unwound from a supply reel 17 and wound onto a take-up reel 18, and record medium 15 is fed upwardly in a direction at right angles to the directions of movement of ribbon 14 and print head 12.

Figure 2:
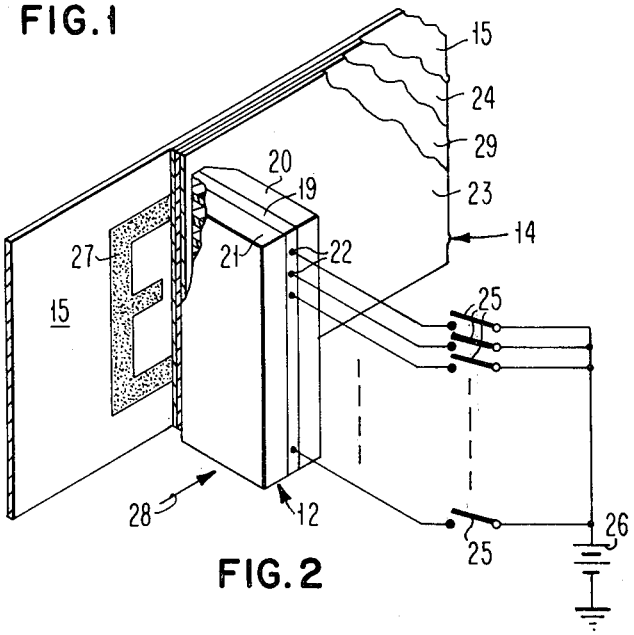
FIG. 2 is a fragmentary perspective view, to enlarged scale, of the print head of the printing apparatus of FIG. 1 in printing position.

As best shown in FIG. 2, print head 12 comprises a relatively thin insulating layer 19 that is interposed between and bonded to facing flat surfaces of two rectangular plate-like elements 20, 21. A plurality of printing electrodes 22 are embedded within insulating layer 19 such that the tip ends of the electrodes 22 are vertically spaced equal distances apart and exposed through the active end of the print head 12; i.e., the end which contacts the resistive ribbon 14.

Ribbon 14 consists solely of a resistive layer 23, a conductive layer 29, and a layer 24 of thermally transferable marking material, such as heat fusible ink or the like. The active end of print head 12 presses against resistive layer 23 with a force sufficient to maintain layer 24 in effective contact with the record medium 15 while it is back-stopped in contact with platen 16.

Referring now to FIG. 2, the printing electrodes 22 are connected to, and selectively energizable by, any suitable means. For sake of simplified illustration, this energizing means is depicted as a plurality of selectively closeable switches 25 (one for each electrode 22) connected to a common voltage source 26.

In operation, upon closure of one of the switches 25 and consequent energization of the corresponding printing electrode 22, current will flow from said electrode 22 via the resistive layer 23 to the conductive layer 29. Conductive layer 29 is suitably connected by connection means (not shown) to a reference potential, such as ground. As current flows through layer 23, the $I^2R$ effect will cause heating of that portion of the layer 23 that extends from the tip end of the electrode 22 to the adjacent elemental area of the conductive layer 29. This localized heating of the resistive layer 23 by the current-resistance effect will cause melting of the thermally transferable material in the contiguous portion of layer 24 and, thereby, form an image on record medium 15.

By concurrent energization of selected ones of the printing electrodes 22 during movement of print head 12 in the direction of arrow 28 relative to ribbon 14 and record medium 15, a desired pattern, such as 27, can be imprinted on the record medium 15.

According to the invention, printing apparatus 10 also includes correcting apparatus comprising a suitable corrective ribbon 30 which is unwound from a supply reel 31 and wound onto a take-up reel 32. Corrective ribbon 30 is positioned substantially parallel to and spaced from printing ribbon 14. A correction device 33 is mounted on carriage 13 in a position adjacent to and spaced from print head 12 with the correction device 33 positioned in alignment with corrective ribbon 30. As shown in FIG. 3*a*, the face 37 of correction device 33 is rectangular, and is of a size sufficient to cover any of the characters in the font. The rectangular face 37 is toward corrective ribbon 30 so that when correction device 33 is actuated, (as shown in FIG. 3) pressure is produced between this face 37 and platen 16, with corrective ribbon 30 and record medium 15 between the face 37 and platen 16.

Corrective ribbon 30 comprises a suitable substrate material 35 which carries a pressure transferable opaque adherent pigmented material 36 on one surface, and the ribbon 30 is mounted so that the pigmented material 36 is toward record medium 15. In a specific embodiment, corrective ribbon 30 comprises a cover-up correction ribbon with a carrier substrate material 35, such as mylar or paper, on which is coated a white pigmented waxy material 36 or some other pigmented adherent material so that, upon pressure contact with the thermoplastic recording material on record medium 15, the pigmented adherent material 36 selectively releases from the substrate material 35 such as in character shaped area 34 and attaches to the printed area.

Figure 3:
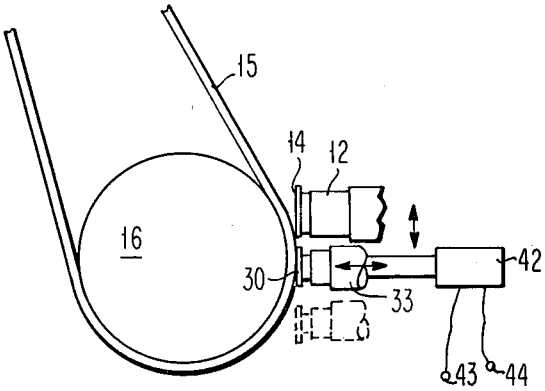
FIG. 3 is a perspective view of the printing apparatus of FIG. 1 in position for correcting an erroneously printed character.
Figure 3A:
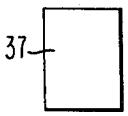
FIG. 3*a* is a view to enlarged scale showing the face of correction device 33.
Figure 4:
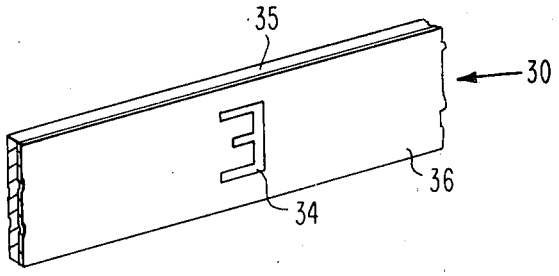
FIG. 4 is a perspective view of the correction ribbon following a correction cycle.

During normal printing operation, the correction device 33 is in the position shown dotted in FIG. 3, and the print head 12 is in printing position, along with printing ribbon 14. However, upon the initiation of a correction cycle, by a special key 50 on keyboard 11, for example, a signal ERASE is generated and print head 12 and correction device 33 are shifted (by conventional shift mechanism, not shown) to the position shown in full line in FIG. 3. If desired, the print head 12 may also be retracted from the position shown to further protect the print head 12 and to further ensure that the record medium 15 is not marked during the correction cycle. The relative timings for the individual steps of the correction cycle are shown in FIG. 7. The timing of the ribbon 30 shift is not critical and can be accomplished either before the backspace operation or subsequent to the backspace operation as shown in FIG. 7.

In the shifted position the correction device 33 and corrective ribbon 30 are in normal print position. The carriage 13 is then backspaced one space (by conventional means, not shown) to position the erroneously printed character adjacent correction device 33. As is conventional in correction cycles, the escapement mechanism for carriage 13 is inhibited during the correction cycle at the time the backspace operation is accomplished. This operation permits the corrected letter to be printed over the correction without requiring an additional backspace operation. Correction device 33 is then energized with a suitable signal ERASE to produce movement toward the corrective ribbon 30. The movement may be produced by an electromagnet 42 in response to the ERASE signal coupled to terminals 43, 44, for example. The movement may also be produced by other electromechanical or mechanical means (not shown). The signal ERASE to energize correction device 33 is of a suitable shape and duration to produce pressure of a predetermined magnitude pressing corrective ribbon 30 into the erroneously printed character on record medium 15. This pressure causes the correcting material 36 to transfer in the character area, but not in the noncharacter area. The reason for this selective transfer is not fully understood. However, it is believed that one reason is that the thermoplastic transfer material comprising the printing is slightly embossed or raised from the surface of the record medium 15 so that greater pressure is generated in the character area. Another factor that may be present is a slight melting at the character edges due to the thermoplastic nature of the ink. The correction technique does provide excellent correction of the erroneously printed character so that the correct character can then be printed at that position.

This correction method for non-impact printing produces the advantage of selective cover-up for the character area only, that is present in impact printing systems. This correction method also produces an additional advantage, in that record medium 15 can be removed from the printer, reinserted and produce correction selectively to the character area only.

Figure 5:
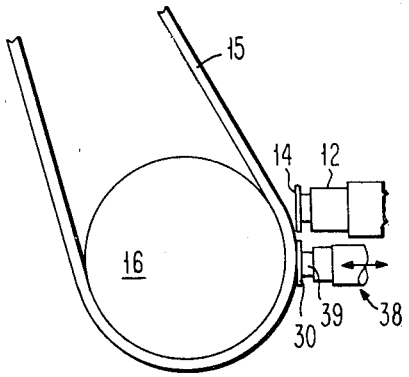
FIG. 5 is a perspective view showing an alternative correction apparatus.
Figure 5A:
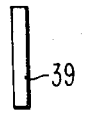
FIG. 5*a* is a view to enlarged scale showing the face of correction device 38.

The embodiment shown in FIG. 5 utilizes a different structure for the correction device. In this embodiment the correction device 38 comprises a blade member 39, the face of which is shown in FIG. 5*a*. Blade member 39 is extended into position to make pressure contact with the correction ribbon 30 in response to the initiation of a correction cycle. The timing of the actuation of the correction device 38 is altered as shown in FIG. 8 so that the blade member 39 is held in the extended position while the carriage 13 is backspaced. This action produces intimate pressure contact between the corrective ribbon 30 and the erroneously printed character. The result of this operation is selective transfer of the correcting ribbon material 36 to the character area only of the erroneously printed character but not to the area of the record medium 15 surrounding the character area.

Figure 6:
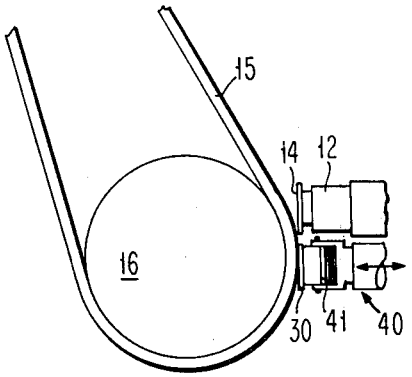
FIG. 6 is a perspective view showing a second alternative correction apparatus.
Figure 6A:
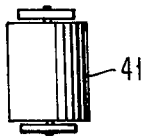
FIG. 6*a* is a view to enlarged scale showing the face of correction device 40.

A further embodiment of a correction device is shown in FIG. 6. In this embodiment the correction device 40 includes a roller member 41 which is extended in response to a signal initiating a correction cycle, to produce a predetermined pressure contact between the corrective ribbon 30 and the erroneously printed character. The timing is chosen as shown in FIG. 8 so that the roller 41 is in the extended position as carriage 13 is backspaced. Roller member 41 is made from a hard material, such as hard rubber, for example. This operation produces selective transfer of the correction ribbon material 36 to the character areas only, and not to the area of the record medium 15 surrounding the character area.

While the invention has been particularly shown and described with reference to a preferred embodiment thereof, it will be understood by those skilled in the art that various changes in the form and details may be made therein without departing from the spirit and scope of the invention.

Having thus described our invention, what we claim as new, and desire to secure by Letters Patent, is:

1. A method for correcting non-impact printed data a character at a time comprising the steps of:

printing the characters with a printing head utilizing a non-impact printing technique which deposits a detectable thickness of thermoplastic marking material on a record medium;

providing a corrective ribbon which carries a pressure transferable opaque adherent pigmented material on one surface thereof;

interposing said corrective ribbon between said record medium and said printing head;

positioning the character to be corrected into an impressing position; and selectively producing pressure to move the corrective ribbon into intimate contact over an area registering with the incremental area of said record medium containing the printed character to be corrected, so that the opaque adherent pigmented material is transferred only to the character to be corrected.

2. The method of claim 1 wherein said positioning step comprises a backspacing operation.

3. The method of claim 2 wherein said step of selectively producing pressure is accomplished after the positioning step.

4. The method of claim 2 wherein said step of selectively producing pressure comprises advancing a correction device into contact with the corrective ribbon prior to the backspacing operation; and maintaining said correction device in contact with said corrective ribbon during said backspacing operation.

5. A method for printing data on a record medium in which wrongly printed characters are corrected, a character at a time, by obscuring the wrong character and over-printing the correct character, characterized in that the characters are printed using a non-impact printing technique which deposits a detectable thickness of thermoplastic material on a record medium and in that a wrong character is obscured by positioning adjacent the wrong character a layer of pressure transferable opaque adherent pigmented material carried on one surface of a corrective ribbon and selectively producing pressure relatively to move the corrective ribbon into intimate contact with the wrong character so that the opaque adherent pigmented material is transferred only to the wrong character.

* * * * *